US007651236B2

(12) United States Patent
Carmouche

(10) Patent No.: US 7,651,236 B2
(45) Date of Patent: Jan. 26, 2010

(54) ADORNMENT FOR ARTICLE OF CLOTHING AND ACCESSORIES

(76) Inventor: Ronald Carmouche, 3201 Kaliste Saloom Rd., Lot #233, Lafayette, LA (US) 70508

( * ) Notice: Subject to any disclaimer, the term of this patent is extended or adjusted under 35 U.S.C. 154(b) by 78 days.

(21) Appl. No.: 11/998,656

(22) Filed: Nov. 30, 2007

(65) Prior Publication Data

US 2008/0130270 A1 Jun. 5, 2008

Related U.S. Application Data

(60) Provisional application No. 60/867,890, filed on Nov. 30, 2006.

(51) Int. Cl.
*F21V 21/108* (2006.01)

(52) U.S. Cl. ..... 362/108; 362/103; 362/249.06; 362/249.17

(58) Field of Classification Search ..... 362/13, 362/108, 396, 249.02, 249.11, 249.06, 249.17
See application file for complete search history.

(56) References Cited

U.S. PATENT DOCUMENTS 4,365,285 A 12/1982 Brundidge
4,556,932 A 12/1985 Lehrer et al.
7,185,997 B2 * 3/2007 Simoni ..... 362/108

* cited by examiner

*Primary Examiner*—John A Ward
(74) *Attorney, Agent, or Firm*—James Ray & Assoc

(57) ABSTRACT

An adornment having a power source for articles of clothing and accessories. Such adornment includes a housing with a front compartment and rear compartment. A front panel is attached to the housing. A predetermined novelty item is securably attached within such front compartment. A plurality of light members are attached securably within such front compartment and are operably connected to such power source. A mirror is attached to the interior walls of the front compartment to create the illusion of depth. A switch mechanism disposed on the housing at a predetermined location is operably connected to the power source to energize the light members. The rear compartment accommodates a power source and is accessible from an outside of the housing by a rear panel releasably attached to the housing to remove and replace such power source as necessary. The housing is attachable to articles of clothing and accessories.

15 Claims, 2 Drawing Sheets

ADORNMENT FOR ARTICLE OF CLOTHING AND ACCESSORIES

CROSS REFERENCE TO RELATED APPLICATION

This patent application is related to and claims priority from U.S. Provisional Patent Application Ser. No. 60/867,890 filed Nov. 30, 2006.

FIELD OF THE INVENTION

The present invention relates, in general, to adornments for articles of clothing and accessories and, more particularly, this invention relates to adornments for articles of clothing and accessories which are particularly eye catching by virtue of having a light component and a mirror component.

BACKGROUND OF THE INVENTION

Prior to the conception and development of the present invention, adornments and accessories, as are generally well known in the prior art, have been used by individuals to complement outfits and gain attention. New and unique items are constantly needed to assist in self expression and to attract attention from others. However, currently no items are available which include the novel aspects of incorporating lights and a mirror within an adornment to attract the attention of others.

Specifically of interest to the present invention are the following: Brundidge, U.S. Pat. No. 4,365,285, discloses an illuminated vehicular seat belt for the purpose of facilitating easy location at night or in unlighted areas such as a parking garage.

Lehrer, et al, U.S. Pat. No. 4,556,932, discloses a battery powered, self contained lighted novelty item, primarily a pin, that includes a light emitting diode within the item to illuminate an area behind a transparent face plate.

SUMMARY OF THE INVENTION

The present invention provides an adornment for articles of clothing and accessories. Such adornment includes a housing having a first predetermined size and first predetermined shape. A front compartment of such housing is enclosed on a first side by a first predetermined material and enclosed on a second side by a second predetermined material. A plurality of light members are housed securably within the front compartment and are operably connected to a predetermined power source, preferably a battery.

The circuit is completed by a switch disposed on such housing at a predetermined location. The switch is operably connected to such predetermined power source for energizing the circuit to the light members producing illumination. There is a rear compartment within such housing for containing the predetermined power source. The rear compartment is accessible by removing a panel from the outside of the housing to remove and replace the power source as necessary.

A predetermined novelty item is securably attached within the front compartment at a predetermined location therein.

The housing removably attaches at a predetermined location thereon to at least one of an article of clothing and an accessory.

OBJECTS OF THE INVENTION

It is, therefore, one of the primary objects of the present invention to provide an adornment for articles of clothing and accessories that is eye-catching and will garner attention from others.

Another object of the present invention is to provide an adornment for articles of clothing and accessories that is pleasing to the wearer and permits the wearer to demonstrate his or her particular sense of style.

Still another object of the present invention is to provide an adornment for articles of clothing and accessories that will complement any outfit.

Yet another object of the present invention is to provide an inexpensive adornment for articles of clothing and accessories that is comfortable for a user to wear and that can be easily attached to various articles of clothing and accessories.

Another object of the present invention is to provide an adornment for articles of clothing and accessories that can be permanently incorporated into various individual articles of clothing and accessories, for example such adornment could be a belt buckle, attached to a purse, or attached to a pair of pants, etc.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
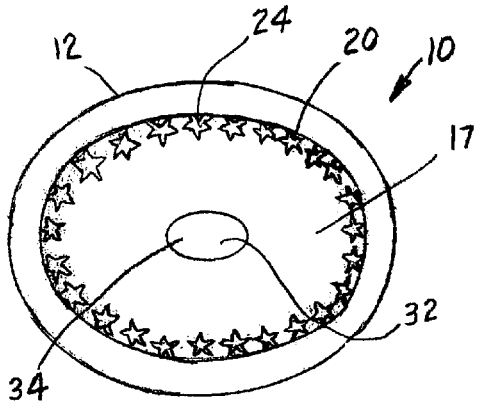
FIG. 1 is a front partial perspective view showing an adornment for articles of clothing and accessories according to a first embodiment of the invention.
Figure 2:
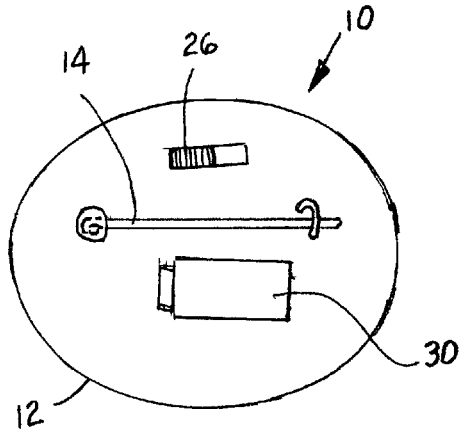
FIG. 2 is a rear partial perspective view showing an adornment for articles of clothing and accessories according to one embodiment of the invention.
Figure 3:
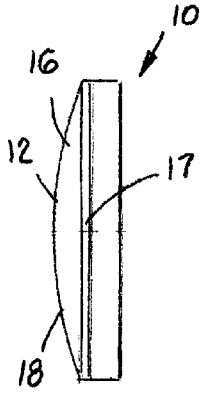
FIG. 3 is a side partial perspective view of an adornment for articles of clothing and accessories according to one embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIGS. 1-9.

An adornment, generally designated 10, having a power source, for articles of clothing and accessories is provided. The adornment 10 includes a housing 12, having a first predetermined size and first predetermined shape. The housing 12 includes a means for attaching the housing 12 to such clothing and accessories. It is presently preferred that such means for attaching the housing 12 to such articles of clothing and accessories is at least one of a pin 14 and a hook and loop type fastening means 15. It is presently most preferred that such fastening means is a pin 14.

The housing 12 also includes a front compartment 16 of a first predetermined height, width, and depth, and having interior walls. It is presently preferred that a mirror 17 is attached to at least one of such interior walls of the front compartment 16.

A front outwardly facing front panel 18, manufactured of a predetermined material, releasably attaches to such front compartment 16. It is presently preferred that said predetermined material is transparent. It is further presently preferred that such predetermined material is selected from the group consisting of plastic and glass. It is presently most preferred that such predetermined material is plastic.

It is presently preferred that the predetermined depth of such front compartment 16 is spaced from the outwardly facing transparent front panel 18 such that the illusion of depth is created and the inside of such front compartment 16 appears to extend indefinitely.

A plurality of light members 20 are attached securably within such front compartment 16 and are operably connected to such power source. It is presently preferred that such light members 20 are light emitting diodes (LED). It is presently most preferred that such light emitting diodes (LED) are star-shaped 24.

A means to complete a circuit 26 is disposed on the housing 12 at a predetermined location and operably connected to such power source for energizing the light members 20.

A rear compartment 28 within the housing 12 has a second predetermined height, width, and depth to accommodate such power source. It is presently preferred that such power source is a battery 29. Such rear compartment 28 has an access panel 30 releasably attached to the housing 12 to provide access to remove and replace such power source as necessary.

A predetermined novelty item 32 is securably attached within such front compartment 16 at a predetermined location therein. It is presently preferred that such novelty item 32 is a cubic zirconium charm 34 of a second predetermined size and second predetermined shape.

Figure 4:
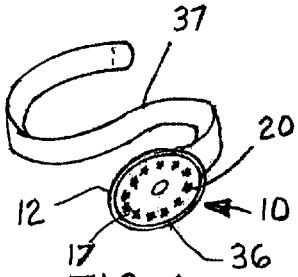
FIG. 4 is a partial perspective view showing an adornment for articles of clothing and accessories according to one embodiment of the invention wherein the adornment is a belt buckle attached to a belt.
Figure 5:
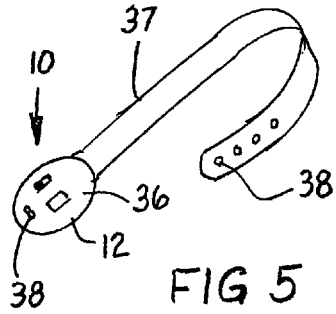
FIG. 5 is a partial perspective view showing an adornment for articles of clothing and accessories according to an embodiment of the invention wherein the adornment is a belt buckle attached to a belt.
Figure 6:
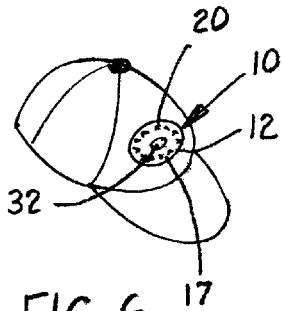
FIG. 6 is a partial perspective view showing an adornment for articles of clothing and accessories according to an embodiment of the invention wherein the adornment is attached to a hat.
Figure 7:
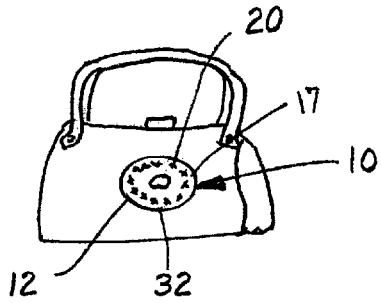
FIG. 7 is a front partial perspective view showing an adornment for articles of clothing and accessories according to an embodiment of the invention wherein the adornment is attached to a purse.

According to a another embodiment of the invention, as illustrated in FIGS. 4-5, the invention is permanently incorporated into an accessory. Specifically, the housing 12 is formed as a belt buckle 36 attached at a predetermined location thereon to a belt 37 and the housing 12 further includes a buckling means 38 for enabling a user to buckle such belt 36 around such user's waist.

Figure 8:
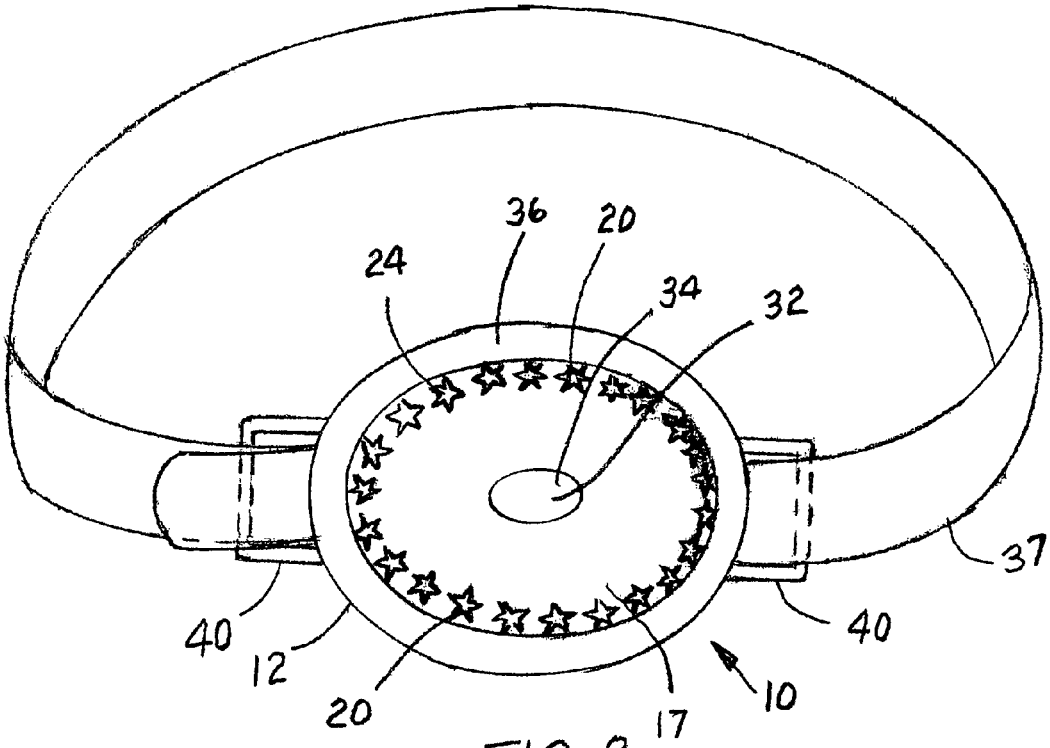
FIG. 8 is a partial perspective view showing an adornment for articles of clothing and accessories according to an embodiment of the invention wherein the adornment is a belt buckle attached to a belt.
Figure 9:
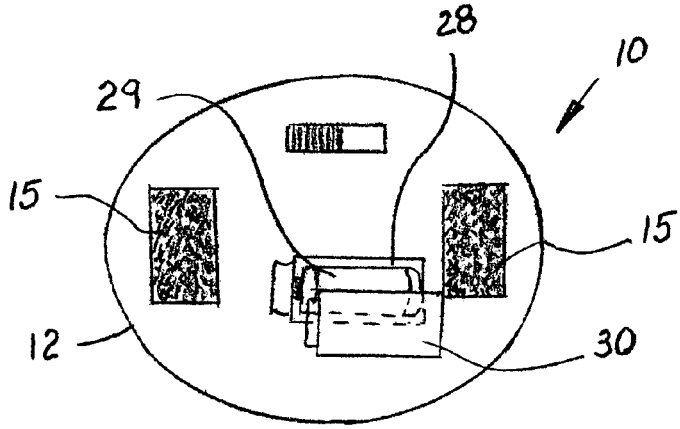
FIG. 9 is a rear partial perspective view showing an adornment for articles of clothing and accessories according to one embodiment of the invention wherein the adornment includes a hook and loop type fastening means.

According to yet another embodiment of the invention, as illustrated in FIG. 8, the invention is permanently incorporated into an accessory. Specifically it is a belt buckle 36 and includes a generally vertical member 40 attached at each end thereof and spaced a distance from such housing 12 to accommodate such belt 37 such that such belt will encircle a user's waist.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. An adornment having a power source for articles of clothing and accessories comprising;

a. a housing having a first predetermined size and first predetermined shape;

b. a means for attaching said housing to such clothing and accessories;

c. a front compartment of a predetermined height, width, and depth, and having interior walls;

d. a front outwardly facing front panel manufactured of a predetermined material releasably attached to said front compartment;

e. a plurality of light members attached securably within said front compartment and being operably connected to such power source;

f. a means to complete a circuit disposed on said housing at a predetermined location and operably connected to such power source for energizing said light members;

g. a rear compartment within said housing having a second predetermined height, width, and depth to accommodate such power source, said rear compartment having an access panel releasably attached to said housing to provide access to remove and replace such power source as necessary; and h. a predetermined novelty item securably attached within said front compartment at a predetermined location therein.

2. An adornment for articles of clothing and accessories according to claim 1 wherein said predetermined material is transparent.

3. An adornment for articles of clothing and accessories according to claim 2 wherein said first predetermined material is selected from the group consisting of plastic and glass.

4. An adornment for articles of clothing and accessories according to claim 2 wherein said first predetermined material is plastic.

5. An adornment for articles of clothing and accessories according to claim 2 wherein a mirror is attached to at least one of said interior walls of said front compartment.

6. An adornment for articles of clothing and accessories according to claim 2 wherein a mirror is attached to each of said interior walls of said front compartment.

7. An adornment for articles of clothing and accessories according to claim 5 wherein said predetermined depth of said front compartment is spaced from said outwardly facing front panel such that the illusion of depth is created and the inside of said front compartment appears to extend indefinitely.

8. An adornment for articles of clothing and accessories according to claim 6 wherein said predetermined depth of said front compartment is spaced from said outwardly facing front panel such that the illusion of depth is created and the inside of said front compartment appears to extend indefinitely.

9. An adornment for articles of clothing and accessories according to claim 1 wherein said novelty item is a cubic zirconium charm of a second predetermined size and second predetermined shape.

10. An adornment for articles of clothing and accessories according to claim 1 wherein said light members are light emitting diodes (LED).

11. An adornment for articles of clothing and accessories according to claim 9 wherein said light emitting diodes (LED) are star-shaped.

12. An adornment for articles of clothing and accessories according to claim 1 wherein said housing is a belt buckle attached at a predetermined location thereon to such belt and said housing further includes a buckling means for enabling a user to buckle such belt around such user's waist.

13. An adornment for articles of clothing and accessories according to claim 1 wherein said housing is a belt buckle and includes a generally vertical member attached at each end thereof and spaced a distance from said housing to accommodate such belt such that such belt will encircle a user's waist.

14. An adornment for articles of clothing and accessories according to claim 1 wherein said means for attaching said housing to such articles of clothing and accessories is a pin.

15. An adornment for articles of clothing and accessories according to claim 1 wherein said means for attaching said housing to such articles of clothing and accessories is a hook and loop type fastening means.

* * * * *